United States Patent [19]

Pignone

[11] 4,286,539

[45] Sep. 1, 1981

[54] DUAL BUOYANCY DEVICE

[76] Inventor: Joseph Pignone, 16 Benvenue Ave., West Orange, N.J. 07052

[21] Appl. No.: 86,173

[22] Filed: Oct. 18, 1979

Related U.S. Application Data

[63] Continuation-in-part of Ser. No. 893,266, Apr. 5, 1978, abandoned.

[51] Int. Cl.[3] ..... B63G 8/14

[52] U.S. Cl. ..... 114/331; 114/121; 114/124; 114/125; 92/101

[58] Field of Search ..... 92/101; 9/8 R; 102/10, 102/8.3 R, 8.3 E; 43/42.22, 43.14; 114/121, 124, 125, 267, 331, 333, 312

[56] References Cited

U.S. PATENT DOCUMENTS

| | | | |
|---|---|---|---|
| 3,254,573 | 6/1966 | Prell | 92/101 |
| 3,314,365 | 4/1967 | Ritchie | 92/107 |
| 3,520,263 | 7/1970 | Berry | 114/331 |
| 3,753,311 | 8/1973 | Boone | 9/8 R |
| 3,943,869 | 3/1976 | Frechette | 114/331 |
| 4,183,316 | 1/1980 | Bennett | 114/125 |

*Primary Examiner*—Trygve M. Blix
*Assistant Examiner*—D. W. Keen
*Attorney, Agent, or Firm*—Norman N. Popper; Daniel H. Bobis

[57] ABSTRACT

A dual buoyancy device having two external dimensions, in the smaller of which, one end is closed by an elastic sheet undistended, and in the greater of which the sheet is distended from its normal position thereby increasing the external dimension of the device; the distention of the sheet is accomplished by a thruster member bearing on the sheet which thruster is impelled by a weight and lever system actuated by gravity, which causes the thruster to distend the sheet.

7 Claims, 4 Drawing Figures

DUAL BUOYANCY DEVICE

CROSS REFERENCES

This application is a continuation-in-part of Ser. No. 893,266 filed Apr. 5, 1978 which is abandoned.

BACKGROUND OF THE INVENTION

1. Field of the Invention

This invention relates generally to a totally self-contained hermetically sealed, immersible device capable of assuming alternately, a non-buoyant and buoyant mode and particularly to a dual buoyancy device which, in its minimum volumetric dimension displaces a volume of liquid whose weight is less than that of the device thus causing it to sink; with an increase to maximum volumetric dimension but with unchanged total weight, the device then displaces a volume of liquid whose weight is greater than that of the device, causing it to rise and float in the liquid.

2. Prior Art

Buoyant devices suitable for attachment to various objects to cause them to be lifted to the surface of a liquid are well known. They are usually made of buoyant material or have a shell-like structure which makes them buoyant.

Under most circumstances, buoyancy of these devices is reduced so that they will sink, and they may be attached to an object. This is usually accomplished by admitting to the interior of the device, sufficient of the liquid in which the device is immersed so that its buoyancy is reduced and it sinks. After attachment to an object, liquid within the device is pumped or otherwise removed restoring its normal buoyancy; which resulting force lifts the attached object to the surface.

SUMMARY OF THE INVENTION

It has been found that a dual buoyancy device can be provided which is capable of increased and decreased buoyancy without admitting any liquid to the interior of the device to make it sink, or without discharging liquid from its interior to make it rise in a liquid. This is accomplished by a device which has a hollow interior whose volume is normally insufficient to make the device buoyant. However, the internal volume of the device can be increased to such a degree that the device becomes buoyant; in either case the total weight of the device remains unchanged. The hermetically sealed device has an elastic sheet at one end which in its undistended state maintains a normal external volumetric dimension for the device. When the device is inverted however, a dome-like member or thruster, mounted on a shaft distends the membrane thereby increasing the external volumetric dimension of the device so that the device will displace additional liquid sufficient to establish buoyancy of the device, previously not buoyant. The thruster, bearing on the inner side of the membrane, is driven by a weight which through a series of levers and links, gravitationally moves to drive the shaft at one end of which the thruster is mounted. A spring is provided to aid the weight in overcoming the resistance of the elastic sheet to being stretched. By attaching the device, in its sinking mode, to an object, it may be utilized to cause an object to be submerged; or by inverting the dual buoyancy device to its floating mode, can cause the attached object to be drawn up with it. Thus the dual buoyancy device when secured to another object singly or in multiples may be converted optionally from a sinking mode to a floating mode to permit an object either to be drawn downwardly or upwardly in a liquid.

DRAWINGS

These objects and advantages as well as other objects and advantages may be obtained by the device shown by way of illustration in the drawings in which.

PREFERRED EMBODIMENT

Figure 1:
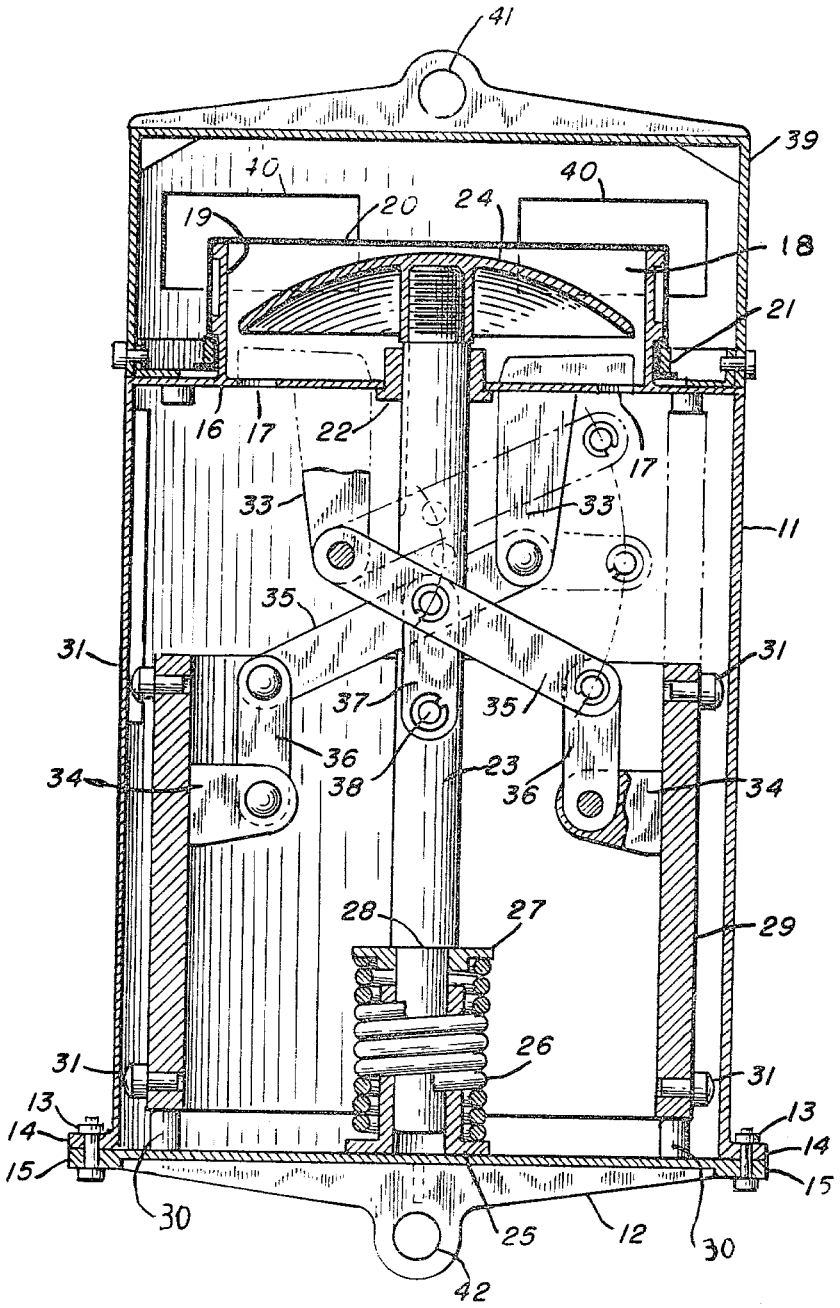
FIG. 1 is a dual buoyancy device in sinking mode.

As shown in FIG. 1, depicting the dual buoyancy device in the sinking mode, there is provided a cylinder 11 having a closure plate 12 at one end. The plate 12 is attached to the cylinder 11 in any suitable manner, as for example, bolts 13, passed through complementary flanges 14, 15, so as to seal the cylinder 11 and the plate 12 together.

The other end of the cylinder 11 is provided with an integral wall 16, having openings 17 therein communicating with an extension chamber 18. The chamber 18 is formed on the opposite side of the plate 12 by an annular collar 19. The collar is closed by an elastic sheet 20, held to the collar by a clamp or contractable band 21.

The center of the plate 12 holds a bushing 22 in which a shaft 23 slides. One end of the shaft 23 is threaded and engaged with a semipherical dome or thruster 24 which engages the elastic sheet 20. The thruster 24, when moved by the shaft 23 distends the said elastic sheet 20 from the position shown in FIG. 1 to the position shown in FIG. 2. Thus when the cylinder 11 is positioned as in FIG. 1, the external volumetric dimension of the assembly is minimal, and when the cylinder 11 is mounted as in FIG. 2, the external dimension of the assembly is maximal.

At the other end of the shaft 23 from the thruster 24, the shaft 23 is slidably positioned in an elongated bushing 25 which is secured to the plate 12, and extends toward the wall 16. Thus the shaft is movable in the bushings 22, 25.

A spring 26 is carried by the bushing 25 and engaged with a radial disc 27 seated on a shoulder 28 in the shaft 23 to move the thruster 24 to distend the elastic sheet 20.

In the position of the assembly shown in FIG. 1, a slidable weight through a plurality of links actuates shaft 23 to overcome the spring 26, and maintains the thruster 24 disengaged from the membrane 20. The weight 29, in the FIG. 1, rests upon bottom studs 30 attached to the closure plate 12. The periphery of the weight 29 is held in spaced relation to the wall of the cylinder 11 by spacers 31 which sustain the weight 29 coaxially and slidably within the cylinder 11. Pairs of guides 32, inside the cylinder 11, position the weight 29 against rotation.

A pair of fulcrum brackets 33 are rigidly secured to the integral wall 16. Another pair of yokes 34 are rigidly attached to the inner wall of the weight 29. Main levers 35 are pivotably attached at one end to the fulcrum brackets 33 and at the other end pivotably to link 36. The other ends of the links 36 are pivotably attached to the yokes 34.

Figure 4:
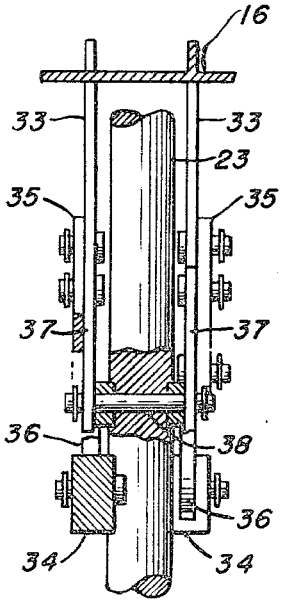
FIG. 4 is a partial side elevational view showing the linkage of the levers to the axial shaft, to the plate and to the tubular weight in the mode shown in FIG. 1.

The main lever 35 is pivotably attached to one end of shaft-links 37. The other end of the shaft-links 37, are pivotably attached to the shaft 23 by a common stud 38 which passes through the shaft as shown in FIG. 4. It will be seen that the shifting of the weight 29 from the position shown in FIG. 1 to the position shown in FIG. 2 will draw the shaft 23 slidably in the bushings 22, 25, to move the thruster 24 into engagement with the elastic sheet 20, to enlarge the external volumetric dimension of the device, whereby it displaces a large volume of liquid in which it is immersed. The total weight of the assembly has not been altered, but the external volumetric dimension of the assembly is increased, thereby altering its buoyancy in response to the gravitational displacement of the weight 29. A cover 39 for protecting the elastic sheet 20 is attached to the cylinder 11. Openings 40 in the cover 39 admit liquid to the inside of the cover 39. The cover 39 has an eye 41 and so is there an eye 42 on the closure plate 12 to permit the dual buoyancy device to be attached to another object.

Relative functional values and component proportions of a typical preferred embodiment are disclosed herein to aid one of ordinary skill in the art to construct a dual buoyancy device. For this purpose, the cylinder 11 of FIG. 1 is represented to be 20 inches in outside diameter and 25 inches in height from closure plate 12 to integral wall 16, its volume thus being 4.5 cubic feet. Chamber 18 from integral wall 16 to membrane 20 to be 4.5 inches and its diameter over the skirt of membrane 20, 15 inches, thus adding a volume of 0.5 cubic foot. The total liquid displacing volume of a device, as shown in FIG. 1 then, becomes 5 cubic feet and if the liquid were to be water, the water would weigh 312 pounds. For a vessel of this volume to be non-buoyant, its total weight would have to exceed 312 pounds by an amount depending on the depth of immersion for which it were to be intended. However, the device as in FIG. 1 is shown to be in air with elastic sheet 20 disposed nominally planar; under immersion, external liquid pressure would force sheet 20 inwardly toward the surface of thruster 24 thereby reducing proportionately the volume and weight of displaced water.

Figure 2:
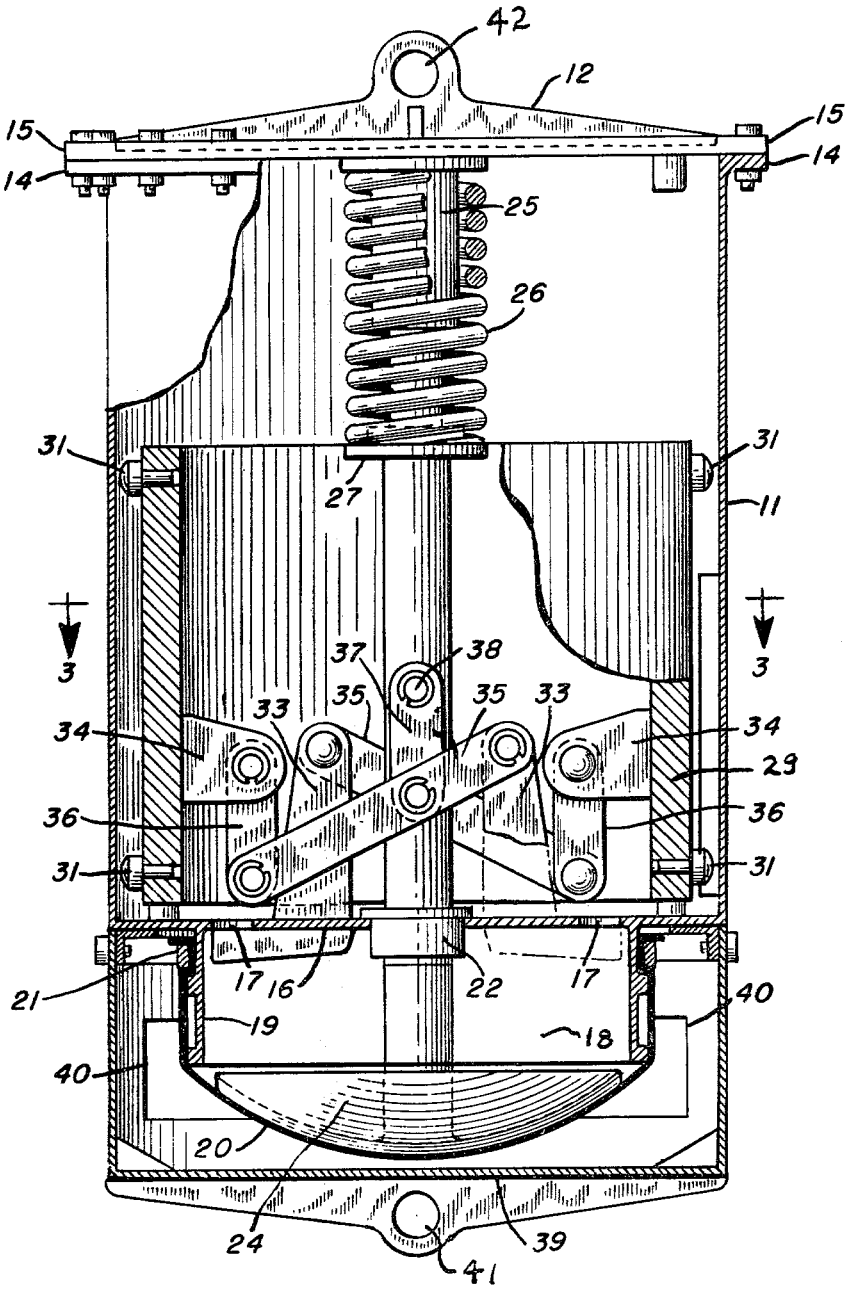
FIG. 2 is a dual buoyancy device in floating mode.
Figure 3:
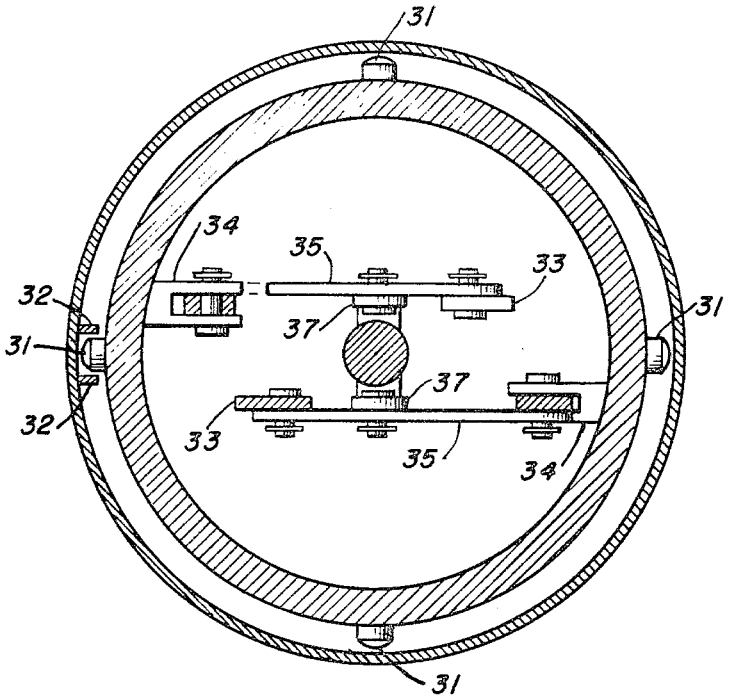
FIG. 3 is a horizontal sectional view of FIG. 2, taken on the line 3—3 looking in the direction of the arrow showing the levers linking the tubular weight pivotably connected to the axial shaft, and to the fulcrum bracket which is rigidly attached to the end plate.

As indicated in FIGS. 1 and 2, lever 35 functions to translate the travel of weight member 29 to the shorter one of shaft 23 and dome 24, the ratio of which being determined by the mechanical advantage of lever 35. The force exerted by weight member 29 in dropping to the position shown in FIG. 2 is increased by the lever by this same ratio. Dimensions of containment cylinder 11 and of weight member 29 can be manipulated to space accommodate a lever of particular required ratio. Referring to FIG. 1, wherein the excursion of lever 35 is indicated in phantom, one of the lever dimensions is from its pivoted engagement with fulcrum bracket 33 to pivoted engagement with shaft-link 37 and the other dimension is from the fulcrum to pivoted engagement with the weight-link 36; the ratio of the two dimensions is the mechanical advantage of the lever and either dimension can be modified to provide a required distention outwardly of membrane 20 and/or a required force behind it.

Assuming the travel of weight member 29, as shown in FIGS. 1 and 2, to be 10.5 inches and a 1 to 3 ratio of lever 35, outward displacement of thruster 24 would then be 3.5 inches. The resulting dimensions of segmented spherical configuration of the elastic sheet 20 would then be, 10.4 inches radius, 3.5 inches height, 15 inches segment base and 0.21 cubic foot volume. Since the volume of the device has been represented previously as 5 cubic feet, the addition of 0.21 cubic foot raises the volume totally to 5.21 cubic feet and the water thus displaced would weigh 325.1 pounds as compared to 312 pounds total weight of the device, thus enabling it to float.

If the shell and components of the device are calculated to weigh 70 pounds exclusive of weight member 29, then the total weight of 312 pounds less 70 pounds, becomes the weight of member 29 at 242 pounds which, when multiplied by 3, the mechanical advantage of lever 35, produces a force of 726 pounds aginst membrane 20. The elastomeric material of the sheet 20 is molded or otherwise preformed substantially to the shape delineated in FIG. 1 and spring 26, preferably of linear spring rate, is calculated approximately to overcome the resistance of sheet 20 to being stretched. With weight member 29 in FIG. 1 disconnected from lever 35, spring 26 should be able to cause sheet 20 to be fully distended outwardly. Characteristics and composition of an elastomeric material for member 20 are difficult to prescribe precisely but minimally it should have accurate memory, be free of fatigue loss and impervious to oil and environmental influence. Because of the counter action of spring 26, latitude is offered in the selection of elastic sheet material of proper Durometer value. However, it must be considered that there is a stretch of 21% since the area of membrane 20 across its plane, as in FIG. 1, is 177 square inches and that the area of its spherical surface, as in FIG. 2, is 215 square inches. Tapering downwardly the thickness of material of the sheet 20 from 0.312 inch at its clamped periphery to 0.156 inch at its center would minimize the possibility of localized stress. The shape of engaging actuating thruster 24 is preferred to be dome-like because surface contact thereby with sheet 20 is progressive radially from its center thus avoiding zones of concentrated stress in the membrane material while being stretched.

The foregoing specification and constructional details of a preferred embodiment of a dual buoyancy device do not limit the intent or scope of this invention. For instance, any other means of connecting the gravitationally actuated weight to the sliding shaft and which transmits motion with mechanical advantage, would serve the same purpose as the preferred lever system described. Likewise, any elastic means distended by a weight to establish buoyancy to a non-buoyant device would serve the same purpose as the thruster and elastic sheet construction described herein.

In the manner described, a device of unchanging weight possessing dual buoyancy, is achieved by reason of optionally increasing or decreasing the volume of liquid it displaces, depending upon external mechanical rotation of the device from an axially erect sinking mode to an inverted floating mode or visa versa.

DEFINITION

This invention operates in accordance with the Principles of Archimedes: a body immersed in a fluid is buoyed up by a force equal to the weight of the fluid displaced, i.e. if the displacement weight of the fluid is greater than the weight of the body, the body floats but if the displacement weight of the fluid displaced is less than the weight of the body, the body sinks.

Elastic sheet as used herein means any structure or member made of any material, and capable of assuming a different shape having variable volumetric capacity and of returning substantially to its original configuration.

Therefore, in accordance with Archimedes' Principle, the phenomenon of dual buoyancy in a device, as described, may be formulated as follows:

$$\frac{3.1416\, r^2 \times H}{1728} + \frac{3.1416\, rx^2 \times Hx}{1728} = Vd$$

$$\frac{1.047\, h^2\,(3rs - h)}{1728} = Vad \text{ (spherical segment)}$$

$$0.785\,(4h^2 + D^2) = A = \text{area, spherical segment (in}^2\text{)}.$$

$$Vd \times 62.4 = Ww$$

$$Ww + (Vad \times 62.4) = (Vd + Vad) \times 62.4.$$

When:

Ww is less than Wd and Vw=Vd, device sinks.

Ww is more than Wd and Vw=Vd+Vad, device rises and floats.

Where:

r=radius of device body in inches.

H=height of device body in inches.

rx=radius of extension chamber in inches.

Hx=height of extension chamber in inches.

rs=radius of sphere in inches.

Ww=weight of displaced water in pounds.

Wd=constant weight of device in pounds.

Vw=volume of displaced water in cubic feet.

Vd=normal external volume of entire device in cubic feet.

Vad=volume added to device by extension of sheet in cubic feet.

APPLICATION

The device herein disclosed will float when the weight of the liquid it displaces is greater than the weight of the device. By nicely altering the dimension of the device, it can be made to displace a greater or lesser weight of liquid, sufficient to either allow the body to float or to sink.

There are only two aspects of the sheet, (1) normally planar (undistended) and (2) maximally distended, which functionally provide dual buoyancy to the device: thus the device is directed specifically either to sink, or to rise and float in a liquid, with no indefinite intermediate degree of buoyancy.

What is claimed is:

1. A dual buoyancy device alternately having a small and a large external dimension comprising, (a) a chamber, (b) an opening in the chamber, (c) an elastic sheet affixed to and hermetically sealing the opening in the chamber, (d) a thruster in the chamber normally gravitationally disposed in nondistending relation to the sheet, (e) the thruster gravitationally movable when the chamber is inverted, to distend the sheet and to enlarge the external dimension of the chamber, (f) the chamber, in sinking mode, with the sheet undistended, being normally externally dimensioned to displace a weight of liquid in which it is immersed, which weight of liquid is less than the weight of the chamber, (g) the chamber, in floating mode, with the thruster distending the sheet to enlarge the external dimension of the chamber, being then dimensioned to displace a weight of liquid which is greater than the weight of the chamber.

2. A dual buoyancy device alternately having a small and a large external dimension comprising, (a) the device according to claim 1, (b) a shaft connected to the thruster, (c) a pair of bushings rigidly mounted within the chamber, (d) the shaft slidable in the bushings.

3. A dual buoyancy device alternately having a small and a large external dimension comprising, (a) the device according to claim 2, (b) a movable weight in the chamber connected to the shaft, (c) the weight normally gravitationally positioned generally at the bottom of the chamber, (d) the weight gravitationally shifted toward the top of the chamber when the chamber is inverted, (e) the thruster urged further by the weight connected to the shaft into engagement with the sheet when the chamber is inverted, to distend the sheet and to enlarge the external dimension of the chamber.

4. A dual buoyancy device alternately having a small and a large external dimension comprising, (a) the device according to claim 3, (b) the connection of the movable weight to the shaft being a plurality of pivotable interconnected levers.

5. A dual buoyancy device alternately having a small and a large external dimension comprising, (a) the device according to claim 4 and, (b) the weight levering the shaft and the thruster attached to the shaft into distending engagement with the sheet when the chamber is inverted and away from the sheet when the chamber is righted.

6. A dual buoyancy device alternately having a small and a large external dimension comprising, (a) a chamber, (b) an opening in the chamber, (c) an elastic, distendable sheet affixed to and hermetically sealing the opening in the chamber, (d) a thruster in the chamber normally gravitationally disposed in nondistending relation to the sheet, (e) the thruster gravitationally movable when the chamber is inverted, to distend the sheet and to enlarge the external dimension, (f) a shaft connected to the thruster, (g) a pair of bushings rigidly mounted within the chamber, (h) the shaft slidable in the bushings, (i) a movable weight in the chamber connected to the shaft, (j) the weight normally gravitationally positioned generally at the bottom of the chamber, (k) the thruster urged further by the weight connected to the shaft into engagement with the sheet when the chamber is inverted, to distend the sheet and to enlarge the external dimension of the chamber, (l) the connection of the movable weight to the shaft being a plurality of pivotable interconnected levers, (m) the weight levering the shaft and the thruster attached to the shaft into distending engagement with the sheet when the chamber is inverted and away from the membrane when the chamber is righted, (n) the chamber, in sinking mode, with the sheet undistended, being normally externally dimensioned to displace a weight of liquid in which it is immersed, which weight of liquid is less than the weight of the chamber, (o) the chamber, in floating mode, with the thruster distending the sheet to enlarge the external dimension of the chamber, being then dimensioned to displace a weight of liquid which is greater than the weight of the chamber.

7. A method for alternately decreasing or increasing the external dimensions of a dual buoyancy device comprising, (a) providing a chamber with an opening, (b) hermetically sealing the chamber with an elastic sheet on the opening, (c) engaging a thruster to distend the sheet when the chamber is inverted, (d) providing a movable weight in the chamber responsive to the force of gravity, (e) connecting the weight to the thruster to further distend the sheet when the chamber is inverted, (f) the chamber, in sinking mode, with the sheet undistended, being normally externally dimensioned to displace a weight of liquid in which it is immersed, which weight of liquid is less than the weight of the chamber, (g) the chamber, in floating mode, with the thruster distending the sheet to enlarge the external dimension of the chamber, being then dimensioned to displace a weight of liquid which is greater than the weight of the chamber.

* * * * *